US011321987B2

(12) United States Patent
Yokoo

(10) Patent No.: US 11,321,987 B2
(45) Date of Patent: May 3, 2022

(54) SHEET HANDLING APPARATUS AND SHEET HANDLING METHOD

(71) Applicant: GLORY LTD., Hyogo (JP)

(72) Inventor: Tomohiro Yokoo, Hyogo (JP)

(73) Assignee: GLORY LTD., Hyogo (JP)

( * ) Notice: Subject to any disclaimer, the term of this patent is extended or adjusted under 35 U.S.C. 154(b) by 177 days.

(21) Appl. No.: 16/163,997

(22) Filed: Oct. 18, 2018

(65) Prior Publication Data

US 2019/0122477 A1 Apr. 25, 2019

(30) Foreign Application Priority Data

Oct. 20, 2017 (JP) ..... JP2017-203421

(51) Int. Cl.

| | |
|---|---|
| ***B65B 25/14*** | (2006.01) |
| ***B65B 5/06*** | (2006.01) |
| ***B65B 7/02*** | (2006.01) |
| ***B65B 43/56*** | (2006.01) |
| ***B65B 51/14*** | (2006.01) |

(Continued)

(52) U.S. Cl.

CPC ..... *G07D 11/17* (2019.01); *B65B 5/067* (2013.01); *B65B 7/02* (2013.01); *B65B 25/14* (2013.01); *B65B 43/56* (2013.01); *B65B 51/146* (2013.01); *B65H 29/46* (2013.01); *B65H 31/02* (2013.01); *B65H 31/3018* (2013.01); *G07D 11/10* (2019.01); *G07D 11/125* (2019.01); *B65H 2301/4212* (2013.01);

(Continued)

(58) Field of Classification Search

CPC ..... B65B 5/045; B65B 5/067; B65B 5/106; B65B 25/14; B65B 27/08; B65B 27/083

USPC ..... 53/527, 570, 244, 284.7

See application file for complete search history.

(56) References Cited

U.S. PATENT DOCUMENTS 4,905,839 A * 3/1990 Yuge ..... G07D 11/34 209/534
9,466,167 B2 * 10/2016 Razzaboni ..... B65B 5/067

(Continued)

FOREIGN PATENT DOCUMENTS

CA 2898541 A1 * 1/2016 ..... B65B 35/02
JP S59-138540 A 8/1984

(Continued)

OTHER PUBLICATIONS

WO-2016136517-A1 Machine Translation (Year: 2020).*

(Continued)

*Primary Examiner* — Anna K Kinsaul
*Assistant Examiner* — Veronica Martin
(74) *Attorney, Agent, or Firm* — Greenblum & Bernstein, P.L.C.

(57) ABSTRACT

A sheet handling apparatus includes a mounting unit configured to mount a storage bag, a holder configured to support a first part of the storage bag mounted to the mounting unit on the holder and hold a second part being lower than the first part of the storage bag, the holder being capable of moving along an first direction in which the sheets are sent from the opening into inside storage bag and a second direction opposite to the first direction. The holder approaches the mounting unit in the second direction opposite to the first direction in a state where the second part of the storage bag is held by the holder before the sheet is stored in the storage bag mounted to the mounting unit.

5 Claims, 7 Drawing Sheets

(51) Int. Cl.

| | |
|---|---|
| ***G07D 11/17*** | (2019.01) |
| ***G07D 11/10*** | (2019.01) |
| ***B65H 31/30*** | (2006.01) |
| ***B65H 31/02*** | (2006.01) |
| ***G07D 11/125*** | (2019.01) |
| ***B65H 29/46*** | (2006.01) |
| *G07D 11/36* | (2019.01) |

(52) U.S. Cl.
CPC ..... *B65H 2301/422544* (2013.01); *B65H 2301/422548* (2013.01); *B65H 2701/1912* (2013.01); *G07D 11/36* (2019.01)

(56) References Cited

U.S. PATENT DOCUMENTS

| | | | | |
|---|---|---|---|---|
| 9,754,436 | B1 * | 9/2017 | Drasinover | G07D 11/009 |
| 10,046,873 | B2 * | 8/2018 | Razzaboni | B65B 35/02 |
| 10,169,944 | B2 * | 1/2019 | Razzaboni | B65B 7/02 |
| 2010/0189379 | A1 * | 7/2010 | Razzaboni | E05G 7/001 383/33 |
| 2011/0052363 | A1 * | 3/2011 | Brexel | B65H 31/26 414/798.2 |
| 2013/0334768 | A1 * | 12/2013 | Hashimoto | B65H 29/46 271/207 |
| 2018/0029730 | A1 * | 2/2018 | Yokoo | B65H 31/34 |

FOREIGN PATENT DOCUMENTS

| | | | | |
|---|---|---|---|---|
| WO | 2016/136517 | A | 9/2016 | |
| WO | WO-2016136517 | A1 * | 9/2016 | B65B 51/146 |

OTHER PUBLICATIONS

European Office Action in corresponding European Application No. 18 201 437.3, dated Mar. 2, 2020.

European Search Report issued with respect to Application No. 18201437.3, dated Mar. 1, 2019.

European Office Action in counterpart European Application No. EP18201437.3-1009, dated Sep. 9, 2020.

* cited by examiner

SHEET HANDLING APPARATUS AND SHEET HANDLING METHOD

CROSS-REFERENCE TO RELATED APPLICATION

This application claims priority to Japanese Patent Application No. 2017-203421 filed on Oct. 20, 2017, the entire contents of which are incorporated herein by reference.

BACKGROUND OF THE INVENTION

1. Field of the Invention

The present invention relates to a sheet handling apparatus for storing sheets inside a storage bag provided with an opening, and a sheet handling method performed by the sheet handling apparatus.

2. Description of the Related Art

As a sheet handling apparatus for performing deposit processing of sheets such as banknotes and the like, there has been conventionally used one in which the sheets taken in into a housing are stored in a storage bag such as a pouch. Such a sheet handling apparatus is used as a part of a cash teller machine installed in a back office area of a store such as a supermarket, and the cash teller machine dispenses money as a change fund to replenish a cash settlement machine installed in a front office area, and deposits money as proceeds from sales collected from the cash settlement machine. As such a sheet handling apparatus, for example, one disclosed in International Patent Publication WO2016/136517 and the like is known.

The banknote handling apparatus disclosed in WO2016/136517 is provided with a banknote storage mechanism for storing the banknotes in a stacked state inside a storage bag having an opening at one side of the storage bag. More specifically, the banknote storage mechanism is provided with a pair of mounting members which is separated from each other and opposed to each other. Two opposing portions of the storage bag near the opening thereof are mounted to the pair of mounting members respectively. Each mounting member is provided with a heating member. The banknote storage mechanism performs the following operation. At first, a predetermined amount of banknotes are stored in a stacked state in the storage bag mounted to the pair of mounting members of the banknote storage mechanism, and then, one mounting member moves toward the other mounting member and these mounting members are in contact with each other. After that, before the storage bag is taken out from the banknote storage mechanism, a portion of the storage bag near the opening thereof is heated by the heating member, and the opening of the storage bag is sealed by heat. In addition, the banknote storage mechanism also includes a stage on which a bottom part of the storage bag mounted to the pair of mounting members is placed. When the banknotes are stored in the storage bag mounted to the pair of mounting members, the stage is gradually moved downward, and a storage space for storing the banknotes inside the storage bag can be maintained.

SUMMARY OF THE INVENTION

In the conventional banknote handling apparatus as disclosed in WO2016/136517, when banknotes are stored in an empty storage bag, there are cases where a bottom part of a storage space for storing the banknotes in the storage bag mounted to the pair of mounting members is oblique. In such cases, the stacked state of the banknotes is not stable as the banknotes are stacked in an inclined state inside the storage bag. If the banknotes are stored inside the storage bag with the stacked state being unstable, the storage amount of the banknotes in the storage bag decreases. In addition, when the opening of the storage bag is sealed by heat applied by a pair of heating members, some banknote in the storage bag may be sandwiched between the pair of heating members via the storage bag, which may result in a seal failure.

The present invention has been made in consideration of the above-mentioned points, and it is an object of the present invention to provide a sheet handling apparatus and sheet handling method which can stabilize a stacked state of sheets when storing the sheets in an empty storage bag by keeping a bottom part of a storage space of the sheets in the storage bag flat in advance.

A sheet handling apparatus of the present invention for storing a sheet inside a storage bag includes: an inlet configured to take in a sheet from outside into the apparatus; a sheet sending unit configured to send the sheet taken in into the apparatus; and a sheet storage mechanism configured to mount the storage bag to store the sheet sent from the sheet sending unit through an opening of the storage bag, the sheet storage mechanism comprising: a mounting unit configured to mount the storage bag; a holder configured to support a first part of the storage bag mounted to the mounting unit on the holder and hold a second part being lower than the first part of the storage bag mounted to the mounting unit, the holder being capable of moving along a first direction in which the sheets are sent through the opening into inside the storage bag and a second direction opposite to the first direction; a driving unit configured to move the holder; and a controlling unit configured to control the driving unit; and the controlling unit controls the driving unit such that the holder approaches the mounting unit in the second direction opposite to the first direction in a state where the second part of the storage bag is held by the holder before the sheet is stored in the storage bag mounted to the mounting unit.

In the sheet handling apparatus of the present invention, before the sheet is stored in the storage bag mounted to the mounting unit, the controlling unit may control the driving unit such that the holder is moved away from the mounting unit in the first direction without holding the storage bag, then the second part of the storage bag is held by the holder, thereafter the holder approaches the mounting unit in the second direction opposite to the first direction in a state where the second part of the storage bag is held by the holder.

In the sheet handling apparatus of the present invention, the holder may include a first holding member and a second holding member, the first holding member may be movable toward and away from the second holding member, and the second part of the storage bag may be sandwiched between the first and second holding members when the first and second holding members approach each other.

In this case, the first part of the storage bag mounted to the mounting unit may be supported on the first holding member and the second holding member.

In the sheet handling apparatus of the present invention, the sheet handling apparatus of the present invention may further include a pusher configured to enter into inside the storage bag mounted to the mounting unit, and push the sheet stored inside the storage bag toward the holder, and the controlling unit may control the pusher such that the pusher enters into inside the storage bag in an empty state mounted to the mounting unit to push the first part of the storage bag toward the holder, after the holder moves close to the mounting unit in the second direction opposite to the first direction while the holder holds the second part of the storage bag.

A sheet handling method of the present invention for storing a sheet inside a storage bag provided with an opening includes: mounting a portion near the opening of the storage bag to a mounting unit and placing at least a first part of the storage bag mounted to the mounting unit on a holder; holding a second part of the storage bag by the holder; moving the holder to approach the mounting unit in a second direction opposite to a first direction in which the sheet is inserted through the opening into the storage bag in a state where the second part of the storage bag is held by the holder, before the sheet is stored in the storage bag mounted to the mounting unit; and storing the sheet in the storage bag mounted to the mounting unit, after the holder approaches the mounting unit.

BRIEF DESCRIPTION OF THE DRAWINGS

FIG. 4 is a perspective view showing a configuration of a banknote storage bag to be mounted to each mounting member of the banknote storage mechanism shown in FIG. 2 and the like.

FIG. 5 is a perspective view showing a state in which the banknote storage bag is mounted to each mounting member of the banknote storage mechanism shown in FIG. 2 and the like.

FIG. 6 is a functional block diagram showing a configuration of a control system of the banknote handling machine shown in FIG. 1 and the like.

FIG. 7 is a side view schematically showing an operation of storing banknotes in the banknote storage bag in the banknote storage mechanism shown in FIG. 2 and the like.

DESCRIPTION OF THE PREFERRED EMBODIMENTS

Figure 5:
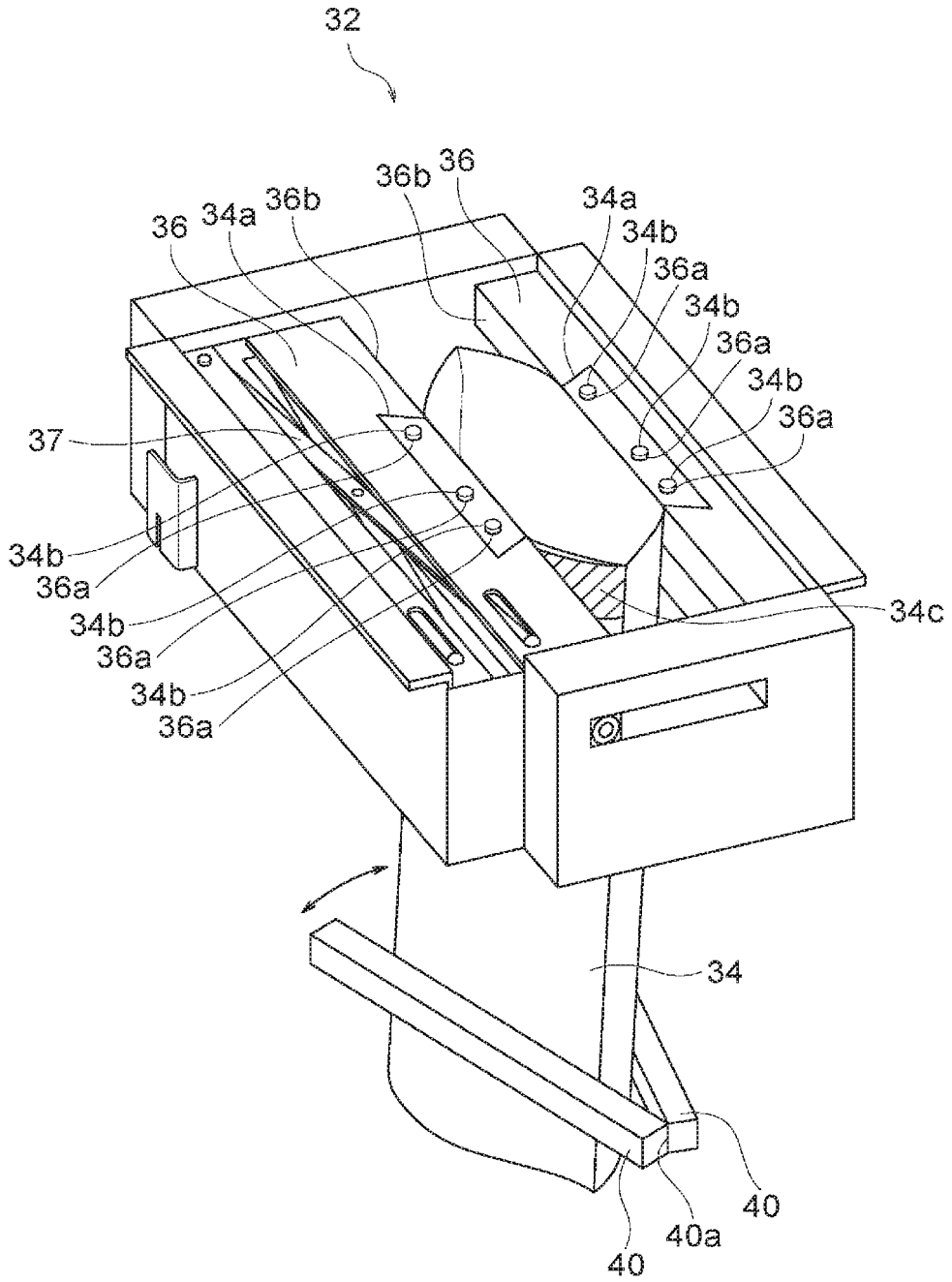
Figure 6:
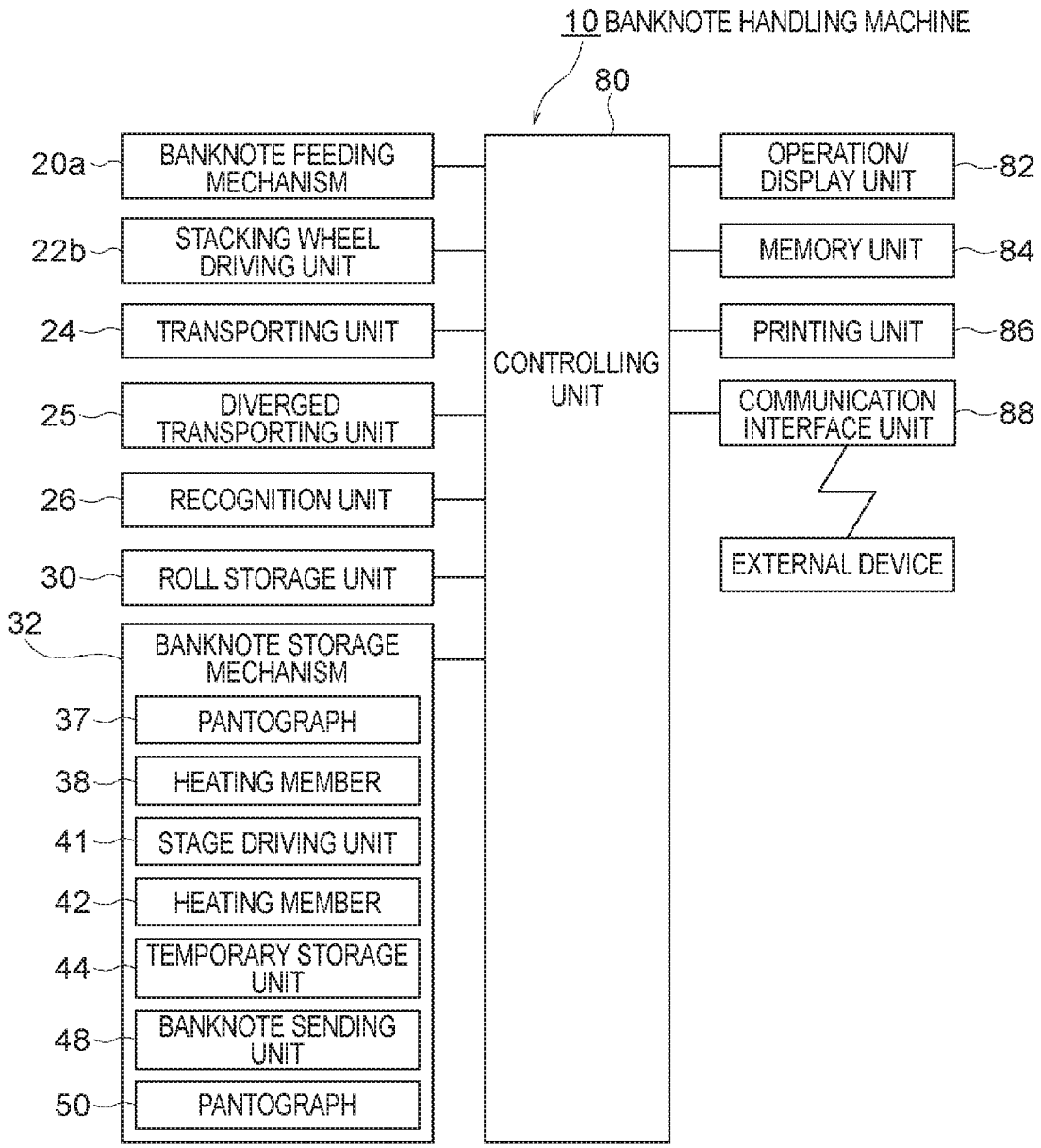
Figure 7:
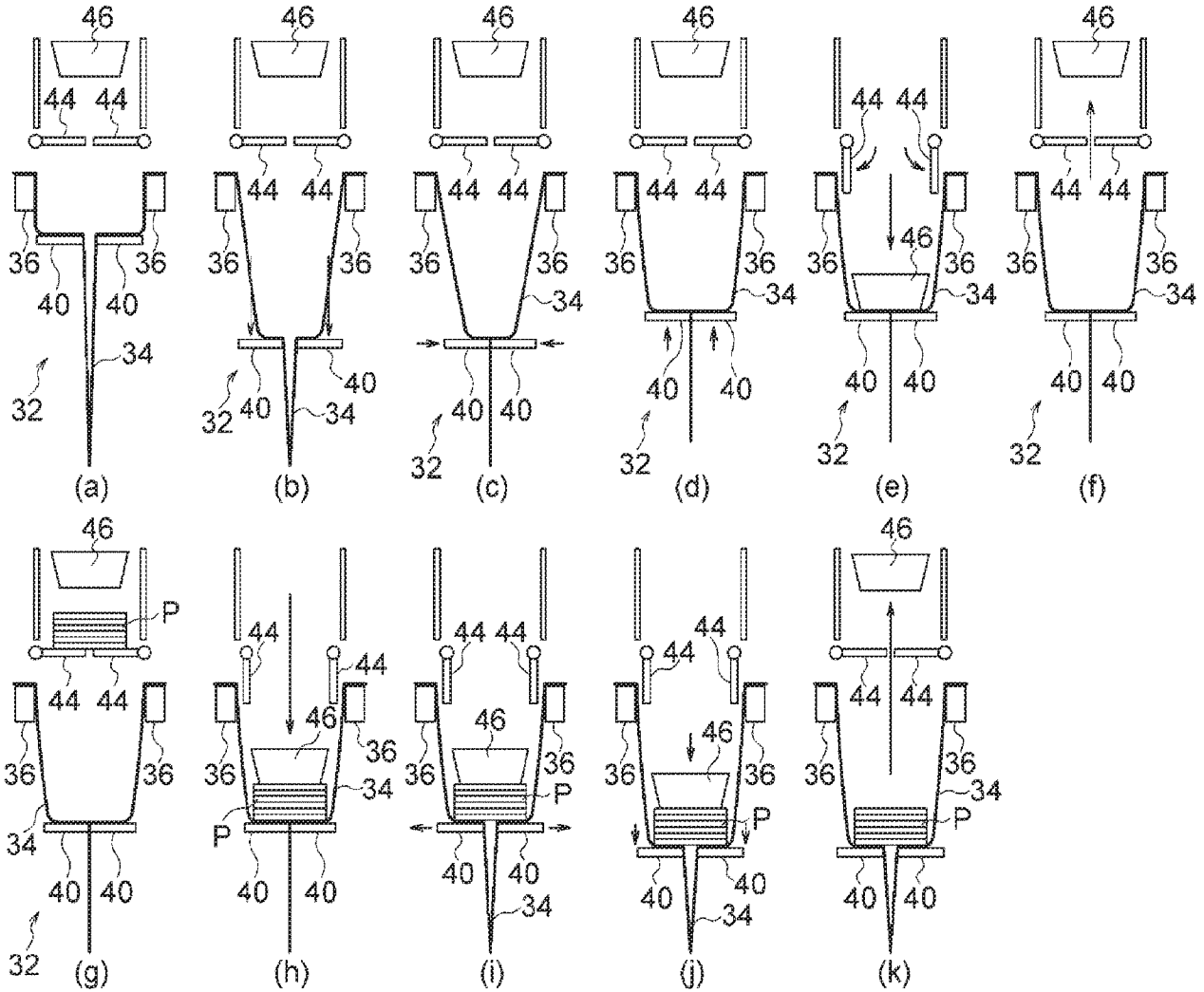

Hereinafter, in an embodiment of the present invention, a case where a banknote handling machine for handling banknotes is used as a sheet handling apparatus according to the present invention will be described. FIGS. 1 to 7 are diagrams showing a banknote handling machine according to the present embodiment and a banknote handling method performed by such a banknote handling machine. In FIG. 7, a plurality of banknotes in a stacked state is indicated by reference P.

Figure 1:
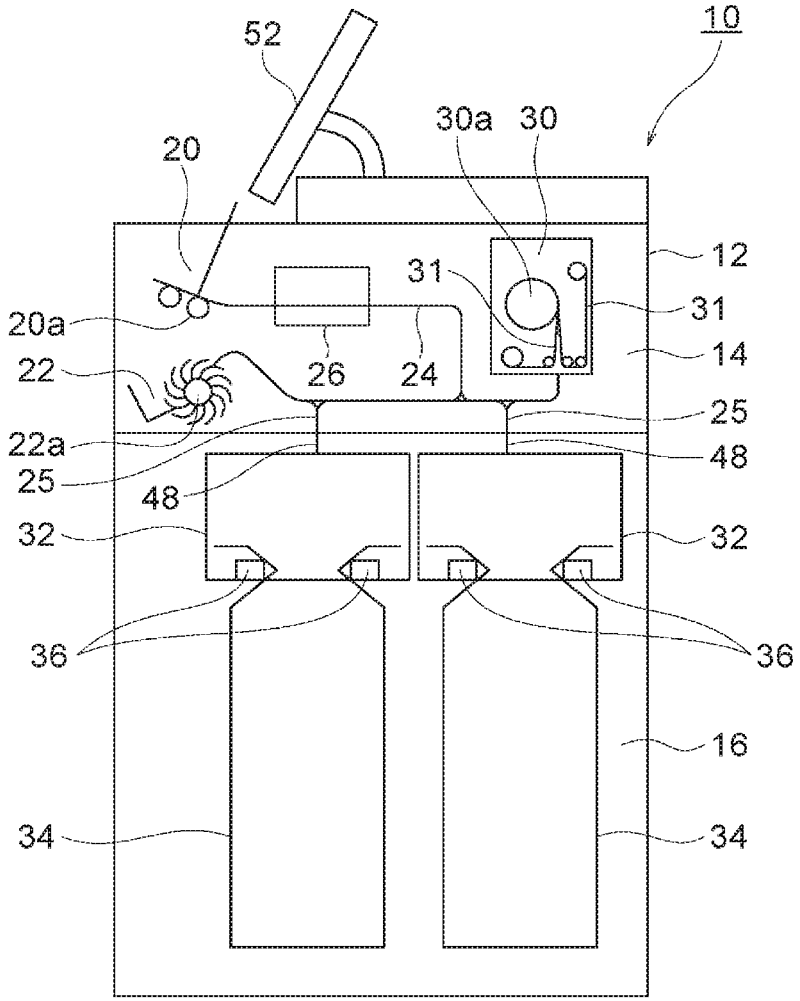
FIG. 1 is a schematic configuration diagram schematically showing an internal configuration of a banknote handling machine according to an embodiment of the present invention.

A banknote handling machine 10 according to the present embodiment is generally installed in a front office area, back office area, or placed in a lobby of a bank or an inside of the bank, and the banknote handling machine 10 can perform various processes such as a deposit processing of banknotes. As shown in FIG. 1, the banknote handling machine 10 according to the present embodiment has a substantially rectangular parallelepiped housing 12. A left side surface of the housing 12 in FIG. 1 is a front surface of the housing 12 (that is, the surface facing an operator). An upper assembly 14 and a lower assembly 16 are arranged inside the housing 12 such that the upper assembly 14 and the lower assembly 16 can be respectively drawn forward from the front surface of the housing 12 (specifically, to the left in FIG. 1). An inlet unit 20 such as a hopper for taking in the banknotes from outside into inside the housing 12 is disposed at the upper assembly 14 and an upper part of the front surface of the housing 12 (the upper part of the left side surface in FIG. 1). Further, an outlet 22 for feeding out the banknotes from inside the housing 12 to outside is disposed at the upper assembly 14 and below the inlet unit 20 in the front surface of the housing 12 (the surface on the left side in FIG. 1).

The inlet unit 20 is provided with a banknote feeding mechanism 20*a* for feeding the banknotes put on the inlet unit 20 in a stacked manner by the operator one by one into the housing 12. A transporting unit 24 for transporting the banknotes one by one in the housing 12 is disposed in the upper assembly 14 inside the housing 12 of the banknote handling machine 10. The banknote fed out from the inlet unit 20 into inside by the banknote feeding mechanism 20*a* is transported one by one by the transporting unit 24. The transporting unit 24 is provided with a recognition unit 26. Each banknote fed out to the transporting unit 24 by the banknote feeding mechanism 20*a* is recognized by the recognition unit 26 for the denomination, authenticity, front/back, fitness, new/old, transportation state.

As shown in FIG. 1, the outlet 22 is connected to the transporting unit 24, and the banknote sent from the transporting unit 24 to the outlet 22 is stacked in the outlet 22. The outlet 22 is accessible from outside the housing 12 so that the operator can take out the banknotes stacked in the outlet 22 from the front surface of the housing 12. A stacking wheel 22*a* is disposed at a connection point between the transporting unit 24 and the outlet 22, and the stacking wheel 22*a* is adapted to rotate in a counterclockwise direction in FIG. 1. When the banknote is sent from the transporting unit 24 to the outlet 22, the stacking wheel 22*a* rotates in the counterclockwise direction in FIG. 1 in a state in which the banknote is held between two blades of the stacking wheel 22*a*. Then, the banknote held between the two blades of the stacking wheel 22*a* is stacked in the outlet 22 in an aligned state.

The transporting unit 24 is provided with a roll storage unit 30 located in the upper assembly 14. The banknote sent from the transporting unit 24 to the roll storage unit 30 is stored in the roll storage unit 30 and the banknotes stored in the roll storage unit 30 can be fed out one by one to the transporting unit 24. More specifically, the roll storage unit 30 is provided with a drum 30*a* rotatable in both forward and reverse directions, and one end of a pair of band-shaped tapes 31 is connected to an outer peripheral surface of the drum 30*a*. When the banknote is sent from the transporting unit 24 to the roll storage unit 30, the banknote is wound on the drum 30*a* by each band-shaped tape 31 such that the banknote and each tape 31 are integrally wound on the drum 30*a*. On the other hand, when each tape 31 is rewound from the drum 30*a* by rotating the drum 30*a* in the reverse direction, the banknote wound on the drum 30*a* is discharged from each tape 31 and is fed out to the transporting unit 24.

Figure 2:
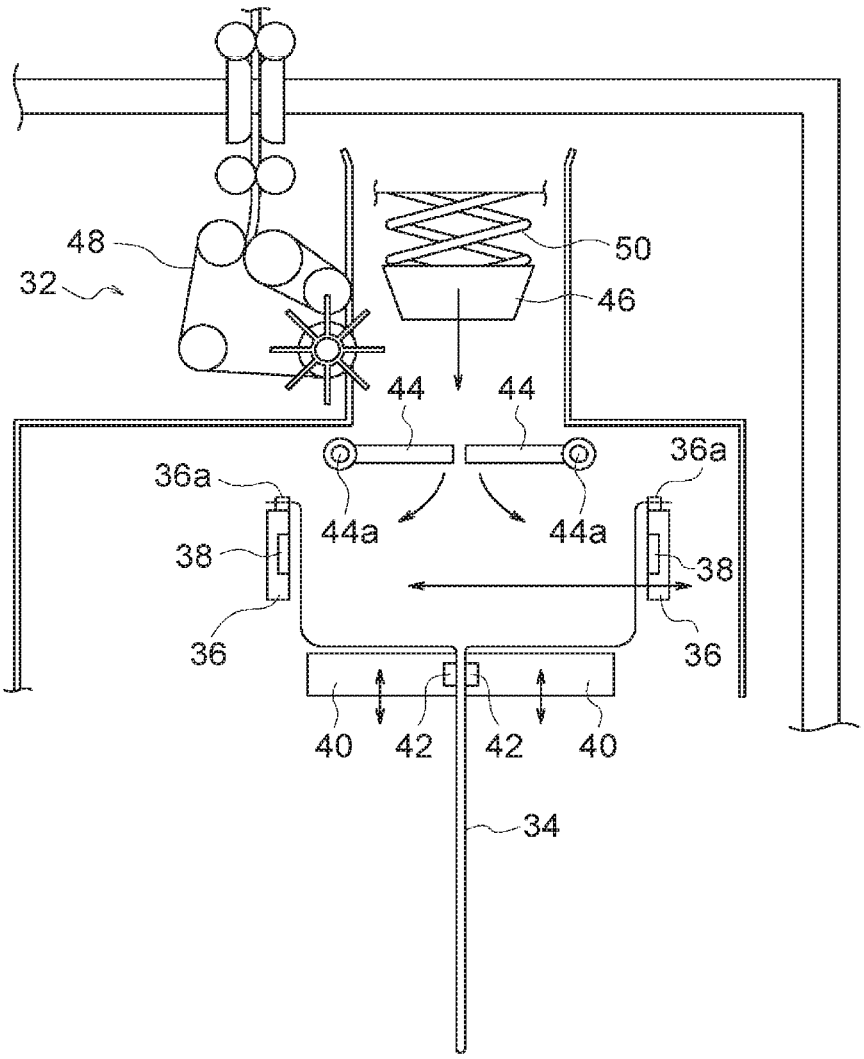
FIG. 2 is a side view showing a detail of a configuration of a banknote storage mechanism in the banknote handling machine shown in FIG. 1.

As shown in FIG. 1, in the present embodiment, a plurality (for example, two) of banknote storage mechanisms 32 are disposed in the lower assembly 16, and each banknote storage mechanism 32 stores banknotes inside a banknote storage bag 34 with an opening for inserting the banknotes. Each banknote storage mechanism 32 is provided with a pair of mounting members 36 being a first mounting member 36 and a second mounting member 36 which space apart from each other and face each other. Two portions facing each other in the vicinity of the opening of the banknote storage bag 34 are mounted to the pair of mounting members 36 respectively. The first mounting member 36 (specifically, for example, the mounting member 36 on the left side in FIGS. 1 and 2) is fixed in a fixed position and does not move from the fixed position. In contrast, the second mounting member 36 (specifically, for example, the mounting member 36 on the right side in FIGS. 1 and 2) can move towards the first mounting member 36 fixed in the fixed positon. As shown in FIG. 2, each mounting member 36 is provided with a heating member 38. A predetermined amount of banknotes are stored in the banknote storage bag 34 mounted to the mounting members 36 in the banknote storage mechanism 32, and then, before the banknote storage bag 34 is taken out from the banknote storage mechanism 32, the first mounting member 36 moves toward the second mounting member 36. The first and the second mounting members 36 are in contact with each other via the banknote storage bag 34, and the heating members 38 heat the portion near the opening of the banknote storage bag 34. As a result, the opening of the banknote storage bag 34 is sealed by heat.

A plurality (two in the example shown in FIG. 1) of diverged transporting units 25 corresponding to the banknote storage mechanisms 32 respectively diverge from the transporting unit 24 located in the upper assembly 14. The banknotes transported from the transporting unit 24 to the diverged transporting units 25 are sent from the diverged transporting units 25 to the banknote storage bags 34 mounted to the banknote storage mechanisms 32 respectively, and stored in the banknote storage bags 34.

Figure 3:
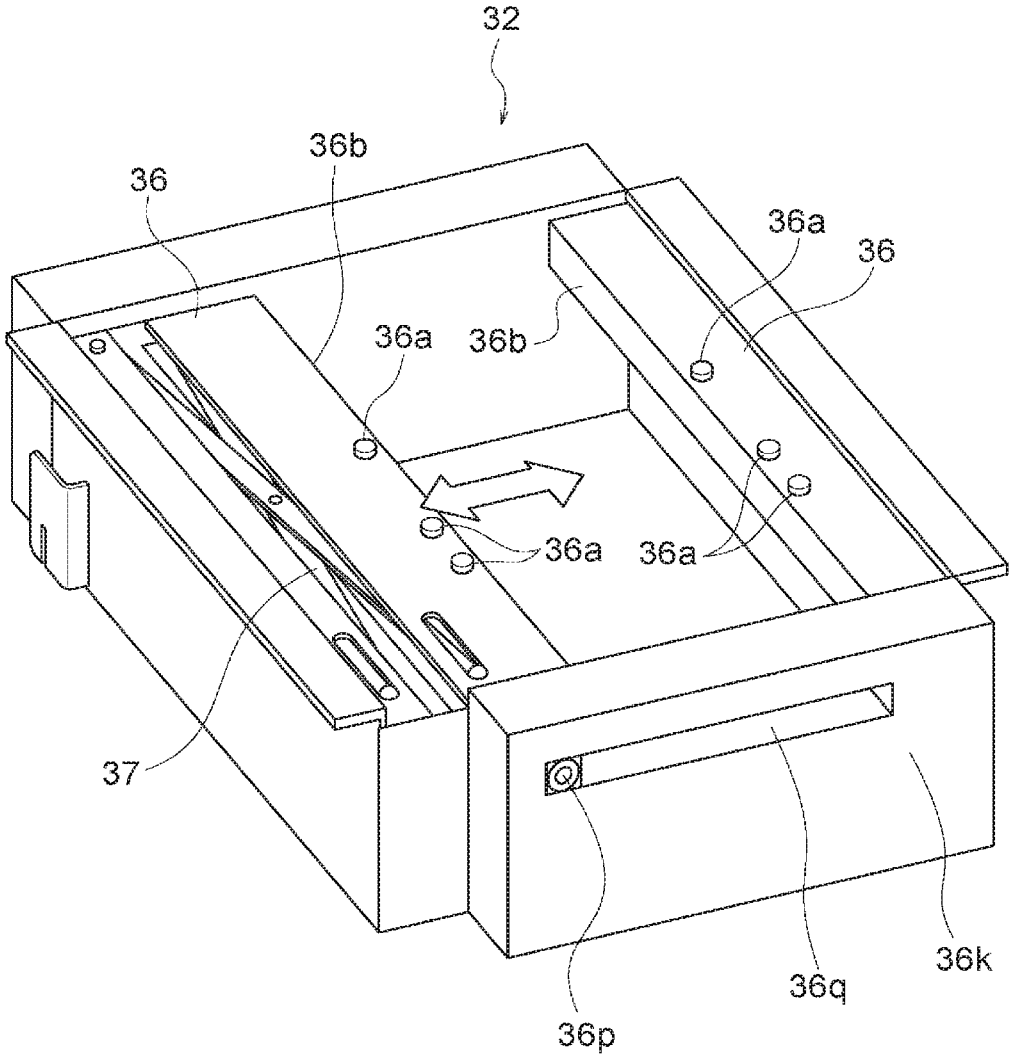
FIG. 3 is a perspective view showing a configuration of a pair of mounting members and the like in the banknote storage mechanism shown in FIG. 2.
Figure 4:
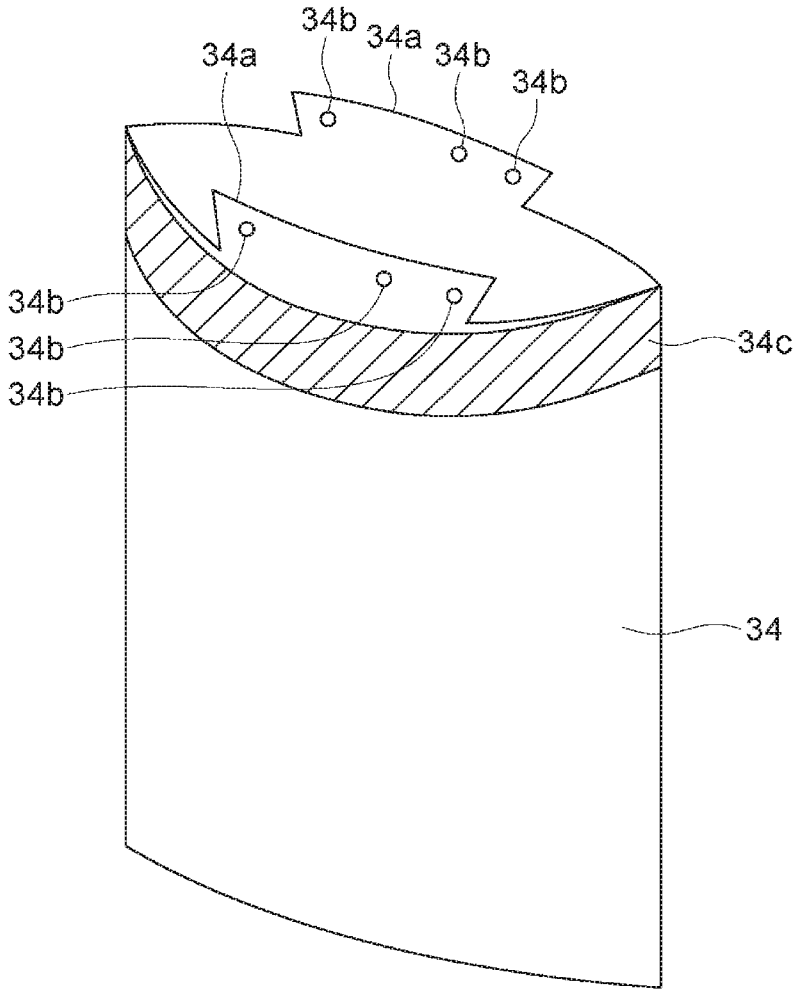

Next, the configuration of the banknote storage mechanism 32 in the present embodiment will be described in detail with reference to FIGS. 2 to 5. FIG. 2 is a side view showing details of the configuration of the banknote storage mechanism 32, FIG. 3 is a perspective view showing a configuration of a pair of mounting members 36 and the like in the banknote storage mechanism 32 shown in FIG. 2, and FIG. 4 is a perspective view showing the configuration of the banknote storage bag 34 to be mounted to each mounting member 36 in the banknote storage mechanism 32 shown in FIG. 2 and the like. FIG. 5 is a perspective view showing a state in which the banknote storage bag 34 is mounted to each mounting member 36 of the banknote storage mechanism 32 shown in FIG. 2 and the like.

As shown in FIG. 2, the banknote storage mechanism 32 is provided with a banknote sending unit 48, temporary storage units 44, and stages 40. The banknotes are transported from the diverged transporting unit 25 of the upper assembly 14 to the banknote sending unit 48 located in the lower assembly 16, and then, to the banknote storage bag 34 mounted to the pair of mounting members 36. The banknotes sent from the banknote sending unit 48 are stored on temporary storage plates being the temporary storage units 44 temporarily. The bottom part of a storage space formed in the banknote storage bag 34 mounted to a pair of mounting members 36 is placed on upper surfaces of the stages 40. The banknotes transported from the banknote sending unit 48 to the banknote storage bag 34 are stored in the storage space formed in the banknote storage bag 34.

As shown in FIG. 2, the banknote sending unit 48 is a combination of roller and belt. The banknotes are transported from the diverged transporting unit 25 of the upper assembly 14 to the banknote sending unit 48 of the lower assembly 16. The banknotes transported to the banknote sending unit 48 are sent onto the temporary storage units 44 one by one, and then stacked on the temporary storage units 44. The temporary storage units 44 are composed of a pair of a first temporary storage unit having a left temporary storage plate and a second temporary storage unit having a right temporary storage plate, and each temporary storage unit 44 can be rotated downward (that is, in a direction of an arrow in FIG. 2) about an axis 44*a* provided at a proximal end portion thereof.

As shown in FIG. 2, the banknote storage mechanism 32 is provided with stages 40. At least a part (a first part) of the banknote storage bag 34 mounted to the mounting members 36 is placed on the upper surfaces of the stages 40. The stages 40 are composed of a pair of a first stage (e.g., a right stage) and a second stage (e.g., a left stage), and each stage 40 is movable in the vertical direction and the horizontal direction in FIG. 2. More specifically, as shown in FIG. 5, the pair of stages 40 are connected to each other by a hinge 40*a* disposed at an end portion of each stage 40. The two stages 40 can swing in a direction of an arrow in FIG. 5 around the hinge 40*a* along a horizontal plane. When the two stages 40 open, a gap is formed between side surfaces of the stages 40. Then, the banknote storage bag 34 mounted to the mounting members 36 can extend downward from the stages 40 through the gap and a lower part of the banknote storage bag 34 can exist under the stages 40. The stages 40 are driven by a stage driving unit 41 (see FIG. 6) such as an electric actuator. More specifically, the stages 40 are moved in the vertical direction in FIG. 2 by the stage driving unit 41 and opened or closed by moving around the hinge 40*a* along the horizontal plane. Note that the pair of stages 40 connected to each other by the hinge 40*a* are opened or closed by moving around the hinge 40*a* as described above, for the sake of convenience, opening or closing movements of each stage 40 about the hinge 40*a* are indicated by the movement in the lateral direction of each stage 40 in FIGS. 2 and 7.

The stages 40 are provided with heating members 42 respectively. When the first stage 40 (for example, the stage 40 on the right side in FIG. 2) is moved toward the second stage 40 (for example, the stage 40 on the left side in FIG. 2) and the stages 40 are in contact with each other via the banknote storage bag 34, the heating members 42 heat a lower portion of the banknote storage bag 34 storing the banknotes therein, and the lower portion of the banknote storage bag 34 is sealed by heat. After that, the banknote storage bag 34 is taken out from the banknote storage mechanism 32. In the banknote storage mechanism 32, instead of moving the first stage 40 of the pair of stages 40 towards the second stage 40, both stages 40 move towards each other and the stages 40 may be in contact with each other.

As shown in FIG. 3, a pantograph 37 having an expansion and contraction mechanism is mounted to the left mounting member 36 of the pair of the left and right mounting members 36. When the first mounting member 36 (e.g., the left mounting member) is moved by the pantograph 37 toward the second mounting member 36 (e.g., the right mounting member), the pair of mounting members 36 are in contact with each other. More specifically, a guide pin 36*p* is disposed at an end of the first mounting member 36. In addition, a linear long hole 36*q* for guiding the guide pin 36*p* is formed in a frame 36*k* for supporting each mounting member 36. Note that the long hole 36*q* is formed so as to extend in a horizontal direction in the frame 36*k*. When the pantograph 37 expands, the guide pin 36*p* disposed at the first mounting member 36 is guided along the long hole 36*q*, whereby the first mounting member 36 is moved toward the second mounting member 36. As a result, a surface 36*b* of the first mounting member 36 comes into contact with a surface 36*b* of the second mounting member 36. It should be noted that in the banknote storage mechanism 32, instead of moving the first mounting member 36 towards the second mounting member 36, both mounting members 36 move to a center position towards the second mounting member 36, whereby these mounting members 36 may be in contact each other at the center position.

Further, as shown in FIG. 3, three pin 36*a* are respectively disposed on upper surfaces of the pair of the first and second mounting members 36. As shown in FIG. 4, a pair of protrusions 34*a* each having three openings 34*b* are disposed at a location near the opening of the banknote storage bag 34 to be mounted to the mounting members 36 (that is, an upper end of the banknote storage bag 34). When the banknote storage bag 34 is mounted to the mounting members 36, each pin 36*a* of each mounting member 36 passes through each opening 34*b* formed in each protrusion 34*a* of the banknote storage bag 34. As a result, these protrusions 34*a* are mounted to the mounting members 36.

As shown in FIG. 4, a band-like reinforcing member 34*c* is disposed at a portion near the opening on an outer surface of the banknote storage bag 34. The reinforcing member 34*c* is made of polyethylene terephthalate, which is stronger in stiffness than the banknote storage bag 34. With such a reinforcing member 34*c*, a force to suppress wrinkles near the opening of the banknote storage bag 34 occurs. Note that "strong stiffness" means that the rigidity against bending is large. As the reinforcing member 34*c*, one with weaker stiffness than the banknote storage bag 34 may be used. Even in this case, the banknote storage bag 34 is provided with the reinforcing member 34*c*, which is another member, so that the stiffness near the opening of the banknote storage bag 34 is strengthened as a whole, and the occurrence of wrinkles near the opening is suppressed.

As shown in FIG. 2, a pusher 46 having a pusher plate is disposed above each temporary storage unit 44. A pantograph 50 having an expansion and contraction mechanism is disposed to the pusher 46. When the pantograph 50 expands or contracts in the vertical direction in FIG. 2, the pusher 46 can move in the vertical direction. When the banknotes temporarily held or supported on each temporary storage unit 44 are stored in the banknote storage bag 34, by moving the pusher 46 downward from a predetermined position shown in FIG. 2, it is possible to push the banknotes held on each temporary storage unit 44 toward the banknote storage bag 34 in a stacked state. In the present embodiment, by combining the pusher 46 and the pantograph 50, a pusher enters into inside the banknote storage bag 34 mounted to the pair of mounting members 36 and pushes the banknotes stored in the banknote storage bag 34.

In addition, the banknote handling machine 10 of the present embodiment includes a controlling unit 80 for controlling components of the banknote handling machine 10. More specifically, as shown in FIG. 6, the controlling unit 80 connects to the components such as the banknote feeding mechanism 20*a* disposed in the inlet unit 20, a stacking wheel driving unit 22*b* for driving the stacking wheel 22*a* disposed in the outlet 22, the transporting unit 24, the diverged transporting unit 25, the recognition unit 26, the roll storage unit 30, the banknote storage mechanism 32 including the pantograph 37, the heating member 38, the stage driving unit 41, the heating member 42, the temporary storage unit 44, the banknote sending unit 48 and the pantograph 50. A signal relating to a recognition result of each banknote by the recognition unit 26 is sent to the controlling unit 80, and the controlling unit 80 controls the operation of the components by sending command signals to the components of the banknote handling machine 10, respectively.

In addition, as shown in FIG. 6, an operation/display unit 82, a memory unit 84, a printing unit 86, and a communication interface unit 88 are respectively connected to the controlling unit 80. As shown in FIG. 1, the operation/display unit 82 is, for example, a touch panel or the like disposed on the upper surface of the housing 12, and information on processing state such as deposit processing of banknotes in the banknote handling machine 10, information on the inventory amount of banknotes stored in each banknote storage bag 34 and the like are displayed on the operation/display unit 82. Further, the operator can give various instructions to the controlling unit 80 by operating the operation/display unit 82. The memory unit 84 memorizes processing history such as deposit processing of banknotes in the banknote handling machine 10 and information on the inventory amount of banknotes stored in each banknote storage bag 34. The printing unit 86 prints processing history such as deposit processing of banknotes in the banknote handling machine 10 and information on the inventory amount of banknotes stored in each banknote storage bag 34 on a receipt or the like. The controlling unit 80 sends and receives signals to and from an external device disposed separately from the banknote handling machine 10 according to the present embodiment (specifically, for example, an upper terminal) via the communication interface unit 88. Specifically, the controlling unit 80 can send the information stored in the memory unit 84 to the external device disposed separately from the banknote handling machine 10 via the communication interface unit 88. For example, when security guards and the like of a cash-in-transit company collect banknotes together with the banknote storage bag 34, information on the collected banknotes is transmitted to the computer or the like of the cash-in-transit company by the communication interface unit 88.

Next, an operation of the banknote handling machine 10 having such a configuration will be described. Note that the operation of the banknote handling machine 10 as shown below is performed by the controlling unit 80 controlling each component of the banknote handling machine 10.

First, the operation on which deposit processing of banknotes is performed in the banknote handling machine 10 will be described. When inputting the banknotes into the inlet unit 20, the operator gives a command of starting deposit processing to the controlling unit 80 through the operation/display unit 82. Then, the banknotes inputted into the inlet unit 20 are fed out one by one into the housing 12 by the banknote feeding mechanism 20*a* and are transported one by one by the transporting unit 24. Each banknote transported by the transporting unit 24 is recognized by the recognition unit 26 for the denomination, authenticity, front/back, fitness, new/old, transportation state. The banknote recognized as not being a normal banknote by the recognition unit 26, namely a reject banknote, is sent to the outlet 22 by the transporting unit 24 and stacked in the outlet 22. Accordingly, the operator can manually remove the reject banknote stacked in the outlet 22 from the front surface of the housing 12 and reinsert it into the inlet unit 20. On the other hand, the banknote recognized by the recognition unit 26 as being a normal banknote is sent to the roll storage unit 30 and temporarily stored in the roll storage unit 30. In addition, the number of the banknotes for each denomination and/or total amount of the banknotes temporarily stored in the roll storage unit 30 is displayed on the operation/display unit 82. When the operator confirms the displayed contents and performs the approval operation of the deposit processing, the banknotes are fed out one by one from the roll storage unit 30 to the transporting unit 24. Then, the banknotes are transported from the transporting unit 24 to the diverged transporting unit 25, and then the banknotes are sent from the diverged transporting unit 25 to the banknote storage bag 34 and stored therein.

If the banknote storage bag 34 to which the banknotes recognized by the recognition unit 26 are to be sent is in a full state or a near full state and the banknote storage bag 34 can not store the banknotes any more, the roll storage unit 30 may be used as a storage unit of the banknotes until the full state or near full state of the banknote storage bag 34 is resolved. More specifically, the banknotes recognized by the recognition unit 26 are sent to the roll storage unit 30 and stored therein. Then, after the banknote storage bag 34 in the full state or the near full state is taken out from the banknote storage mechanism 32 of the lower assembly 16 by the security guard of the cash-in-transit company or the clerk of the shop and then an empty banknote storage bag 34 is mounted to the banknote storage mechanism 32, the banknotes are fed out one by one from the roll storage unit 30 to the transporting unit 24 and sent to the banknote storage bag 34 by the transporting unit 24.

Next, with reference to FIG. 7, the operation of each banknote storage mechanism 32 will be explained in a case where the banknotes sent from the diverged transporting unit 25 of the upper assembly 14 to the lower assembly 16 are stored in the banknote storage bag 34 mounted to the pair of mounting members 36.

FIG. 7(*a*) is a diagram showing a state when the empty banknote storage bag 34 where no banknotes are stored therein is mounted to the banknote storage mechanism 32. As shown in FIG. 7(*a*), when the empty banknote storage bag 34 is mounted to the banknote storage mechanism 32, two opposing portions in the vicinity of the opening of the banknote storage bag 34 are mounted to the mounting members 36. When the empty banknote storage bag 34 is mounted to the banknote storage mechanism 32, each stage 40 is located at an initial position which is an upper end position. As a result, a part (a first part) of the banknote storage bag 34 mounted to the mounting members 36 is placed on the upper surfaces of the stages 40.

After the empty banknote storage bag 34 is mounted to the mounting members 36, the operator inputs a command indicating the completion of the mounting of the banknote storage bag 34 to the controlling unit 80 through the operation/display unit 82. Then, as shown in FIG. 7(*b*), the stages 40 are moved downward from the initial position to a lower end position by a predetermined distance in a vertical direction by the stage driving unit 41. As a result, the part placed on the upper surfaces of the stages 40 of the banknote storage bag 34 mounted to the mounting members 36 is lowered than the first part of the banknote storage bag 34. Thereafter, as shown in FIG. 7(*c*), the respective stages 40 move toward each other, and another part (a second part) of the banknote storage bag 34 is sandwiched between the respective stages 40. As a result, the middle part of the banknote storage bag 34 mounted to the mounting members 36 is supported by the side surfaces of the stages 40. The middle part of the banknote storage bag 34 is the part between the first and the second part of the banknote storage bag 34.

Thereafter, as shown in FIG. 7 (*d*), the stages 40 are moved upward by the stage driving unit 41 in a state where the middle part of the banknote storage bag 34 mounted to the mounting members 36 is held or sandwiched between the side surfaces of the stages 40. As a result, the mounting members 36 to which the upper end portion of the banknote storage bag 34 is mounted and the stages 40 which hold the middle part of the banknote storage bag 34 approach each other in the vertical direction. Therefore, the bottom part of the storage space formed in the banknotes in the banknote storage bag 34 mounted to the mounting members 36 is kept in a flat state. At this time, the stages 40 may be moved to the initial position which is the upper end position, or may be moved to a predetermined position which is located between the initial position and the lower end position. Thereafter, as shown in FIG. 7(*e*), the temporary storage units 44 simultaneously in a downward direction (that is, a direction of the arrow in FIG. 2) around the axis 44*a* of the shaft at the end portion of the temporary storage units 44. In synchronism with the operation of the temporary storage units 44, the pantograph 50 expands downward, and the pusher 46 attached to the lower end of the pantograph 50 also moves downward in the vertical direction. As a result, the pusher 46 enters the inside of the banknote storage bag 34 mounted to the mounting members 36, and the part of the middle banknote storage bag 34 placed on the stages 40 is pushed toward the stages 40 by the pusher 46. As a result, the bottom part of the storage space of the banknote storage bag 34 mounted to the mounting members 36 becomes even more flat. Thereafter, as shown in FIG. 7(*f*), the pusher 46 moves upward, and the pusher 46 retracts upward from the banknote storage bag 34. In this way, in the banknote storage mechanism 32, the preparation of the banknote storage bag 34 before the banknotes are stored is completed.

In the banknote storage mechanism 32, when the banknotes are stored in the banknote storage bag 34, as shown in FIG. 7(*g*), the banknotes sent from the diverged transporting unit 25 of the upper assembly 14 to the lower assembly 16 are sent by the banknote sending unit 48 onto the temporary storage units 44 and are stacked on the temporary storage units 44. Then, as shown in FIG. 7(*h*), after the banknotes are supported on the temporary storage units 44, each temporary storage unit 44 is rotated simultaneously downward about the axis 44*a* of the shaft arranged at the end portion of the temporary storage plate of the temporary storage unit 44 (that is, in the direction of the arrow in FIG. 2). Then, the banknotes stacked on the temporary storage units 44 fall from the temporary storage units 44 by their own weight and are stored in the storage space formed in the banknote storage bag 34. In synchronism with the operation of each temporary storage unit 44, the pantograph 50 expands downward, and the pusher 46 attached to the lower end of the pantograph 50 also moves downward. As a result, when the banknotes temporarily supported on the temporary storage units 44 are stored in the banknote storage bag 34, the banknotes remaining on the temporary storage units 44 can be pushed toward the banknote storage bag 34 by the pusher 46.

When the banknotes fall from the temporary storage units 44 and are stored in the banknote storage bag 34, the stages 40 are moved downward by the stage driving unit 41. At this time, the storage space for storing the banknotes sent from each temporary storage unit 44 is formed inside the banknote storage bag 34. More specifically, after the pantograph 50 expands downward and the pusher 46 moves downward, the respective stages 40 move in a direction away from each other as shown in FIG. 7(*i*) and the gap is formed between the respective stages 40. As a result, the banknote storage bag 34 mounted to the mounting members 36 is not held or sandwiched between the side surfaces of the stages 40. Thereafter, as shown in FIG. 7(*j*), the stages 40 and pusher 46 move integrally downward in the vertical direction in FIG. 2 in a state where the banknotes stored in the banknote storage bag 34 are pushed toward the stages 40 by the pusher 46. Then, when the pusher 46 reaches the lower end position and a detection sensor (not shown) detects that the pusher 46 reaches the lower end position, the stages 40 are stopped. In this manner, when the stages 40 are lowered, the banknotes are pushed toward the stages 40 inside the banknote storage bag 34 by the pusher 46 until the pusher 46 reaches the lower end position. As a result, the banknotes stacked in the banknote storage bag 34 in a stacked state are compressed in the stacking direction. Therefore, it is possible to prevent the banknotes stored in the stacked state inside the banknote storage bag 34 from collapsing. After each stage 40 is stopped, as shown in FIG. 7(*k*), the pusher 46 moves upward, and the pusher 46 retracts upward from the banknote storage bag 34.

Further, when the stages 40 are moved downward, and the stages 40 are detected by a lower end position detection sensor (not shown), it is regarded that the banknotes stored in the banknote storage bag 34 has become in the full state or the near full state. In this case, after the pusher 46 retracts upward from the banknote storage bag 34, the opening of the banknote storage bag 34 is sealed by heat from the heating members 38. Furthermore, when the banknotes are stored in the banknote storage bag 34, the banknote storage bag 34 is sealed by the heating members 42. The sealed part of the banknote storage bag 34 is located at the bottom part of the storage space formed in the banknote storage bag 34. Thereafter, the respective mounting members 36 move to separate each other. Further, the stages 40 move to separate each other. Thereafter, the banknote storage bag 34 is removed from the mounting members 36, and the banknote storage bag 34 can be taken out upward from the upper side of the mounting members 36 of the banknote storage mechanism 32.

According to the banknote handling machine 10 of the present embodiment having such a configuration and the banknote handling method performed by such a banknote handling machine 10, each stage 40 (holder) is movable, along a first direction (that is, the downward direction in FIG. 2) in which the banknotes are inserted into the banknote storage bag 34 from the opening thereof and a second direction opposite to the first direction (that is, the upward direction in FIG. 2). Further, at least the part (first part) of the banknote storage bag 34 mounted to each mounting member 36 (mounting unit) is placed on each stage 40 and each stage 40 holds another part (second part) of the banknote storage bag 34. Also, before the banknotes are stored in the banknote storage bag 34 mounted to each mounting member 36, with each stage 40 holding the part of the banknote storage bag 34, each stage 40 is moved along the second direction opposite to the first direction (that is, the upward direction in FIG. 2) to approach each mounting member 36. Thus, the bottom part of the storage space in the banknote storage bag 34 can be made flat beforehand. Therefore, when the banknotes are stored in the empty banknote storage bag 34, it is possible to stabilize the stacked state of the banknotes.

More specifically, in a conventional banknote handling machine, when storing banknotes in an empty banknote storage bag, if the bottom part of the storage space in the banknote storage bag mounted to the pair of mounting members is oblique, since the banknotes are stacked in a state inclined obliquely inside the banknote storage bag, the stacked state is not stable. If the banknotes are stored inside the banknote storage bag with the stacked state being unstable, the storage amount of the banknotes in the banknote storage bag decreases. In addition, when the opening of the banknote storage bag is sealed with the pair of heating members, some banknote in the banknote storage bag may come into contact with the heating member, which may result in a seal failure. On the other hand, in the banknote handling machine 10 and the banknote handling method of the present embodiment, before the banknotes are stored in the banknote storage bag 34 mounted to each mounting member 36, with each stage 40 holding the part of the banknote storage bag 34, each stage 40 is moved along the second direction opposite to the first direction (that is, the upward direction in FIG. 2) to approach each mounting member 36. As a result, each mounting member 36 to which the portion near the opening in the banknote storage bag 34 is mounted and each stage 40 holding the middle part of the banknote storage bag 34 approach each other in the vertical direction. Therefore, the bottom part of the storage space of the banknotes in the banknote storage bag 34 mounted to each mounting member 36 becomes in a flat state. Therefore, when storing the banknotes in the empty banknote storage bag 34, it is possible to stabilize the stacked state of the banknotes.

Further, in the banknote handling machine 10 of the present embodiment, as described above, each stage 40 is separated from each mounting member 36 along the first direction in a state where the banknote storage bag 34 is not held by each stage 40, before the banknotes are stored in the banknote storage bag 34 mounted to each mounting member 36 (see FIG. 7(*b*)). Thereafter, the part of the banknote storage bag 34 is held by each stage 40 (see FIG. 7(*c*)), and then each stage 40 is moved in the second direction opposite to the first direction (that is, the upward direction in FIG. 2) to approach each mounting member 36 (see FIG. 7(*d*)), with each stage 40 holding part of the banknote storage bag 34. In this case, after each stage 40 is separated from each mounting member 36, each stage 40 is brought close to each mounting member 36 in a state where the part of the banknote storage bag 34 is held by each stage 40. Therefore, it is possible to sufficiently secure a moving distance when each stage 40 approaches each mounting member 36, so that the bottom part of the storage space of the banknotes in the banknote storage bag 34 is made even more reliably flat.

Further, in the banknote handling machine 10 of the present embodiment, as described above, the first stage 40 is movable in directions toward and away from the second stage 40, respectively. Then, when the stages 40 approach each other, the part of the banknote storage bag 34 is sandwiched between the stages 40, whereby the part of the banknote storage bag 34 is held by each stage 40.

Further, in the banknote handling machine 10 of the present embodiment, as described above, each stage 40 functioning as a holder also functions as a placing unit on which at least the part of the banknote storage bag 34 mounted to each mounting member 36 is placed and supporting the banknotes stored inside the banknote storage bag 34. In addition, the pusher 46 and the pantograph 50 are disposed as a pusher for pushing the banknotes toward each stage 40 inside the banknote storage bag 34 by entering inside the banknote storage bag 34 mounted to each mounting member 36. With each stage 40 holding the part of the banknote storage bag 34, each stage 40 is moved in the second direction opposite to the first direction to approach each mounting member 36. Thereafter, the pusher is controlled so as to enter the empty banknote storage bag 34 mounted to each mounting member 36 and push the part of the banknote storage bag 34 toward each stage 40. In this case, by pushing the part of the banknote storage bag 34 from the inside of the banknote storage bag 34 toward each stage 40 by the pusher 46, the bottom part of the storage space of the banknotes in the banknote storage bag 34 can be made even more reliably flat.

Note that the banknote handling machine 10 and the banknote handling method according to the present embodiment are not limited to the above described aspects, and various modifications can be made.

For example, in the banknote handling method performed by the above banknote handling machine 10, before the banknotes are stored in the banknote storage bag 34 mounted to each mounting member 36, the pusher (specifically, the pusher 46) enters the inside of the empty banknote storage bag 34 and the part of the banknote storage bag 34 is pushed to each stage 40 from the inside, after each stage 40 is moved upward while the part of the banknote storage bag 34 is held by each stage 40. However, the present invention is not limited to such an aspect. In the banknote handling machine and the banknote handling method according to the modified example, after each stage is moved upward in a state where a part of the banknote storage bag is held by each stage, the part of the banknote storage bag may not be pushed to each stage by the pusher.

Also, the holder that can hold a part of the banknote storage bag mounted to each mounting member is not limited to one composed of a pair of stages. As a holder, as long as at least a first part of the banknote storage bag mounted to each mounting member is placed and a second part of the banknote storage bag can be held, a single stage or another component may be used instead of the pair of stages.

In a banknote handling machine according to another modified example, a tubular banknote storage bag provided with openings at the top and the bottom may be supported by a supporting unit, and banknotes are stored in the banknote storage bag supported by the supporting unit. Even in this case, the principle of the present invention can be applied to the banknote handling machine according to the modified example described above.

Also, instead of heat sealing the opening of the storage bag with heating members, the opening of the storage bag may be adhered and sealed with an adhesive. Specifically, as a banknote storage bag in which banknotes are stored, a banknote storage bag in which an adhesive is disposed at the opening on the inner surface thereof may be used. In this case, opening of the banknote storage bag can be sealed by adhering the opening of the banknote storage bag with the adhesive. Even in this case, the principle of the present invention can be applied to the banknote handling machine according to the modified example described above.

Also, a heating member for heat sealing the opening of the banknote storage bag may be a member different from each mounting member to which the portion near the opening of the banknote storage bag is mounted. Further, a heating member for heat sealing the bottom part of the banknote storage bag when banknotes are stored therein may be a member different from each stage. Also, the bottom part of the banknote storage bag when banknotes are stored therein may not be sealed. In this case, heating member is not disposed at each stage and the like.

In the banknote handling method performed by the above banknote handling machine 10, each stage 40 is moved in the vertical direction and the banknote storage bag 34 is mounted with the opening facing upward. However, the present invention is not limited to such an aspect. In the banknote handling machine and the banknote handling method according to the modification example, each stage may move in a substantially horizontal direction (front-rear direction or left-right direction as seen from the front of the banknote handling machine) or may move in the inclination direction. Further, in the banknote handling method performed by the above banknote handling machine 10, the banknote storage bag 34 is mounted to each mounting member 36 so that the opening is on the upper side. However, the present invention is not limited to such an aspect. The banknote storage bag may be mounted to the mounting unit so that the opening of the banknote storage bag faces the horizontal direction or the inclined direction. Also, the direction in which banknotes are stacked is not limited. For example, the banknotes may be stacked as in the embodiment shown in FIGS. 1 to 7, or the banknotes may be stacked along the horizontal direction in a substantially standing state.

In the banknote handling method performed by the above banknote handling machine 10, at least a first part of the banknote storage bag 34 is placed on each stage 40 and each stage 40 holds at least a second part of the banknote storage bag 34. However, the present invention is not limited to such an aspect. That is, a member on which at least a first part of the banknote storage bag is placed and a member for holding at least a second part of the banknote storage bag may be separately disposed.

Further, as a sheet handling apparatus or sheet handling method according to the present invention, a storage bag which stores sheets (for example, checks, vouchers and the like) other than banknotes may be used.

What is claimed is:

1. A sheet handling apparatus for storing sheets inside of a storage bag comprising:

an inlet through which sheets are taken in from outside of the sheet handling apparatus;

a mounting unit configured to mount an opening portion of a storage bag thereto;

a temporary storage unit configured to stack thereon, the sheets taken in through the inlet and transport the stacked sheets therefrom to the mounted storage bag;

a pair of stages on which the mounted storage bag is placed and which are configured to be moved in a horizontal direction toward and away from each other and configured to be moved downward and upward in a vertical direction between an upper end position and a lower end position, wherein the stages are not in contact with each other via the mounted storage bag so as not to sandwich hold therebetween the mounted storage bag when the stages are moved in the horizontal direction away from each other, and are in contact with each other via the mounted storage bag so as to sandwich hold therebetween the mounted storage bag when the stages are moved in the horizontal direction toward each other;

a pusher member configured to be moved in the vertical direction between above the temporary storage unit and inside of the mounted storage bag and configured to push the mounted storage bag placed on the stages when the pusher member enters into inside of the mounted storage bag;

a controlling unit configured to control the sheet handling apparatus such that the stages on which the mounted storage bag is placed and which are in the horizontal direction away from each other are moved downward from the upper end position to the lower end position first when the pusher member is above the temporary storage unit, second the stages on which the mounted storage bag is placed are in contact with each other via the mounted storage bag so as to sandwich the mounted storage bag therebetween, and third the stages sandwiching the mounted storage bag therebetween are moved upward to the upper end position or a predetermined position between the upper end position and the lower end position, and thereafter the pusher member is moved downward from above the temporary storage unit to inside of the mounted storage bag to push the mounted storage bag placed on the stages and is moved upward from inside of the mounted storage bag to above the temporary storage unit, and thereafter the sheets stacked on the temporary storage unit are transported to the mounted storage bag.

2. The sheet handling apparatus according to claim 1, wherein the controlling unit is configured to control the sheet handling apparatus such that the pusher member pushes the sheets stored in the storage bag toward the stages after the sheets stacked on the temporary storage unit are transported to the mounted empty storage bag.

3. The sheet handling apparatus according to claim 1, wherein the controlling unit is configured to control the sheet handling apparatus such that the stages are moved downward from the upper end position to the lower end position after a command indicating completion of the mounting of the storage bag is inputted to the controlling unit.

4. The sheet handling apparatus according to claim 3, wherein the controlling unit is configured to control the sheet handling apparatus such that the stages are moved upward to the upper end position or to the predetermined position when the stages approach the mounting unit in the upward direction.

5. The sheet handling apparatus according to claim 1, wherein the controlling unit is configured to control the sheet handling apparatus such that the stages move in the downward direction after the sheets stacked on the temporary storage unit are transported to the mounted storage bag.

* * * * *